US012405034B2

(12) United States Patent
Rossi et al.

(10) Patent No.: US 12,405,034 B2
(45) Date of Patent: Sep. 2, 2025

(54) COMPACT HEAT PUMP FOR COLD CLIMATE APPLICATIONS

(71) Applicant: WorkSport Ltd., Richmond Hill (CA)

(72) Inventors: Lorenzo Rossi, Richmond (CA); Martin Agelin-Chaab, Oshawa (CA); Bismark Addo-Binney, Oshawa (CA); Sheldon Williamson, Oshawa (CA)

(73) Assignee: WorkSport Ltd., Vaughan (CA)

( * ) Notice: Subject to any disclaimer, the term of this patent is extended or adjusted under 35 U.S.C. 154(b) by 126 days.

(21) Appl. No.: 18/319,927

(22) Filed: May 18, 2023

(65) Prior Publication Data

US 2024/0003595 A1 Jan. 4, 2024

Related U.S. Application Data

(60) Provisional application No. 63/365,008, filed on May 19, 2022.

(51) Int. Cl.

| | |
|---|---|
| ***F25B 7/00*** | (2006.01) |
| ***F24F 1/14*** | (2011.01) |
| ***F25B 30/02*** | (2006.01) |

(52) U.S. Cl.

CPC ..... *F25B 7/00* (2013.01); *F24F 1/14* (2013.01); *F25B 30/02* (2013.01)

(58) Field of Classification Search

CPC .... F25B 7/00; F25B 1/10; F24F 1/14

See application file for complete search history.

(56) References Cited

U.S. PATENT DOCUMENTS

| | | | | |
|---|---|---|---|---|
| 4,306,420 | A * | 12/1981 | Cann | F25B 1/10 62/196.2 |
| 7,948,207 | B2 * | 5/2011 | Scheucher | H02J 3/322 324/427 |
| 2021/0344279 | A1 * | 11/2021 | Sharifzadeh | H02M 7/4833 |
| 2024/0027116 | A1 * | 1/2024 | Takegami | F25B 49/02 |
| 2024/0035711 | A1 * | 2/2024 | Cambio | F25B 7/00 |

* cited by examiner

*Primary Examiner* — Miguel A Diaz

(74) *Attorney, Agent, or Firm* — Honigman LLP; Eric J. Sosenko; Jonathan P. O'Brien

(57) ABSTRACT

A heat pump system is provided. The heat pump system includes a first compressor and a second compressor and a first heat exchanger, a second heat exchanger, and a third heat exchanger. The system further includes a first expansion device, a second expansion device, and a third expansion device. When the system operates in a cascade heating mode, the third heat exchanger is configured to: receive a first portion of refrigerant from the first compressor and a second portion of refrigerant from the second compressor, and provide a first consistent flow of refrigerant to the first compressor and a second consistent flow of refrigerant to the second compressor so as to improve an efficiency of the system.

16 Claims, 3 Drawing Sheets

COMPACT HEAT PUMP FOR COLD CLIMATE APPLICATIONS

CROSS-REFERENCE TO RELATED APPLICATION

This application claims priority under 35 U.S.C. § 119(e) to U.S. Provisional Application 63/365,008, filed on May 19, 2022. The disclosure of this prior application is considered part of the disclosure of this application and is hereby incorporated by reference in its entirety.

TECHNICAL FIELD

This disclosure relates to a heat pump system that is configured to operate efficiently in cold climate conditions.

BACKGROUND

A heat pump, which is a thermal energy transferring system, is able to heat or cool an enclosed space by transferring thermal energy. When used to cool a building, a heat pump works like an air conditioner by transferring heat from inside the building to the outdoors. When used to heat a building, the heat pump operates in reverse, such that heat is transferred from the outdoors to the inside of the building.

In an air source heat pump system, the efficiency of the heat pump system (e.g., Coefficient of Performance (COP)) is directly dependent on the temperature of the ambient air, which is the source of the thermal energy for heating indoor air. Accordingly, the COP of the heat pump is high when the ambient temperature is high. Likewise, the COP of the heat pump is low when the ambient temperature is low. As a result, in cold climates where the ambient air temperature often drops below −10° C., the COP of the heat pump is very poor, such that the air source heat pump system is not practical to use. Further, when the ambient air temperature is low, not only is the COP of the heat pump poor as discussed, but the heating capability of the heat pump is also poor since it is difficult to extract or absorb thermal energy from the cold ambient air.

SUMMARY

In one aspect, a heat pump system configured to provide a consistent flow of refrigerant to one or more compressors in the system is provided. The heat pump system includes a plurality of compressors including a first compressor and a second compressor; a plurality of heat exchangers including a first heat exchanger, a second heat exchanger, and a third heat exchanger; a plurality of expansion devices including a first expansion device, a second expansion device, and a third expansion device. When the system operates in a cascade heating mode, the third heat exchanger is configured to: receive a first portion of refrigerant from the first compressor and a second portion of refrigerant from the second compressor, and provide a first consistent flow of refrigerant to the first compressor and a second consistent flow of refrigerant to the second compressor.

In one aspect, the third heat exchanger includes a flash-tank-heat-exchanger.

In another aspect, the third heat exchanger is configured to contain a mixture of liquid refrigerant and vapor refrigerant.

In another aspect of the system, before received by the third exchanger, the first portion of refrigerant passes through the first heat exchanger and the third expansion device. In such an aspect, the first heat exchanger is located indoors.

In another aspect, the third heat exchanger is configured to output a vapor portion of a mixture of the first portion and second portion of the refrigerant via a first output and a liquid portion of mixture of the first portion and second portion of the refrigerant via a second output. In such an aspect, the first output of the third heat exchanger is in fluid communication with an input of the first compressor when the system operates in the cascade heating mode. Further, the second output of the third heat exchanger may be in fluid communication with the second expansion device when the system operates in the cascade heating mode.

In another aspect, the second expansion device is in fluid communication with the second heat exchanger when the system operates in the cascade heating mode. The second heat exchanger may be in fluid communication with an input port of the second compressor when the system operates in the cascade heating mode. In yet another aspect, the second heat exchanger is located outdoors.

The system may include one or more of the following aspects: the first compressor includes a high-pressure compressor; the second compressor includes a low-pressure compressor; the first compressor and the second compressor are in operation when the system operates in the cascade heating mode; and when the system operates in a heating or a cooling mode, the first compressor is in operation and the second compressor is not in operation.

In another aspect of the disclosure relates to a heating and cooling system. The heating and cooling system includes a fuel cell unit; a backup battery unit including a battery management circuitry; a direct current (DC) to alternate current (AC) converter; and a heat pump system, wherein the modular multi-level converter is configured to: receive direct current from the fuel cell or the backup battery unit; convert the direct current to alternate current; and supply the alternate current to the heat pump system. The heat pump system includes a plurality of compressors including a first compressor and a second compressor; a plurality of heat exchangers including a first heat exchanger, a second heat exchanger, and a third heat exchanger; a plurality of expansion devices including a first expansion device, a second expansion device, and a third expansion device. When the system operates in a cascade heating mode, the third heat exchanger is configured to: receive a first portion of refrigerant from the first compressor and a second portion of refrigerant from the second compressor, and provide a first consistent flow of refrigerant to the first compressor and a second consistent flow of refrigerant to the second compressor.

In one aspect, the DC to AC converter includes a nine-level modular multi-level convert.

In another aspect, the fuel cell unit includes a hydrogen storage tank, a fuel cell, and a condenser.

In yet another aspect, wherein the battery management circuitry is configured to maintain the backup battery.

DESCRIPTION OF DRAWINGS

Like reference symbols in the various drawings indicate like elements.

DETAILED DESCRIPTION

Implementations herein are directed toward a heat pump system (e.g., air source heat pump system) including a liquid receiver (e.g., third heat exchanger 150 in FIG. 1) to overcome the inefficiency associated with current heat pump systems. In particular, the liquid receiver is configured to provide a consistent flow of refrigerant to one or more compressors in the system. The consistent flow also supplies an outdoor heat exchanger (e.g., second heat exchanger 140 in FIG. 1) with consistent flow of the refrigerant which is colder than ambient air temperature. Thus, the heating capability and the COP of the heat pump are maintained even when the ambient air temperature is very low, e.g., −30° C. As will be described in the present disclosure, the heat pump system operates in various modes including cooling mode, heating mode for normal climate conditions, and cascaded heating mode for cold climate conditions. The efficiency of the heat pump system in all modes of operation is improved by the liquid receiver which provides a consistent pressure to the heat exchangers.

Figure 1:
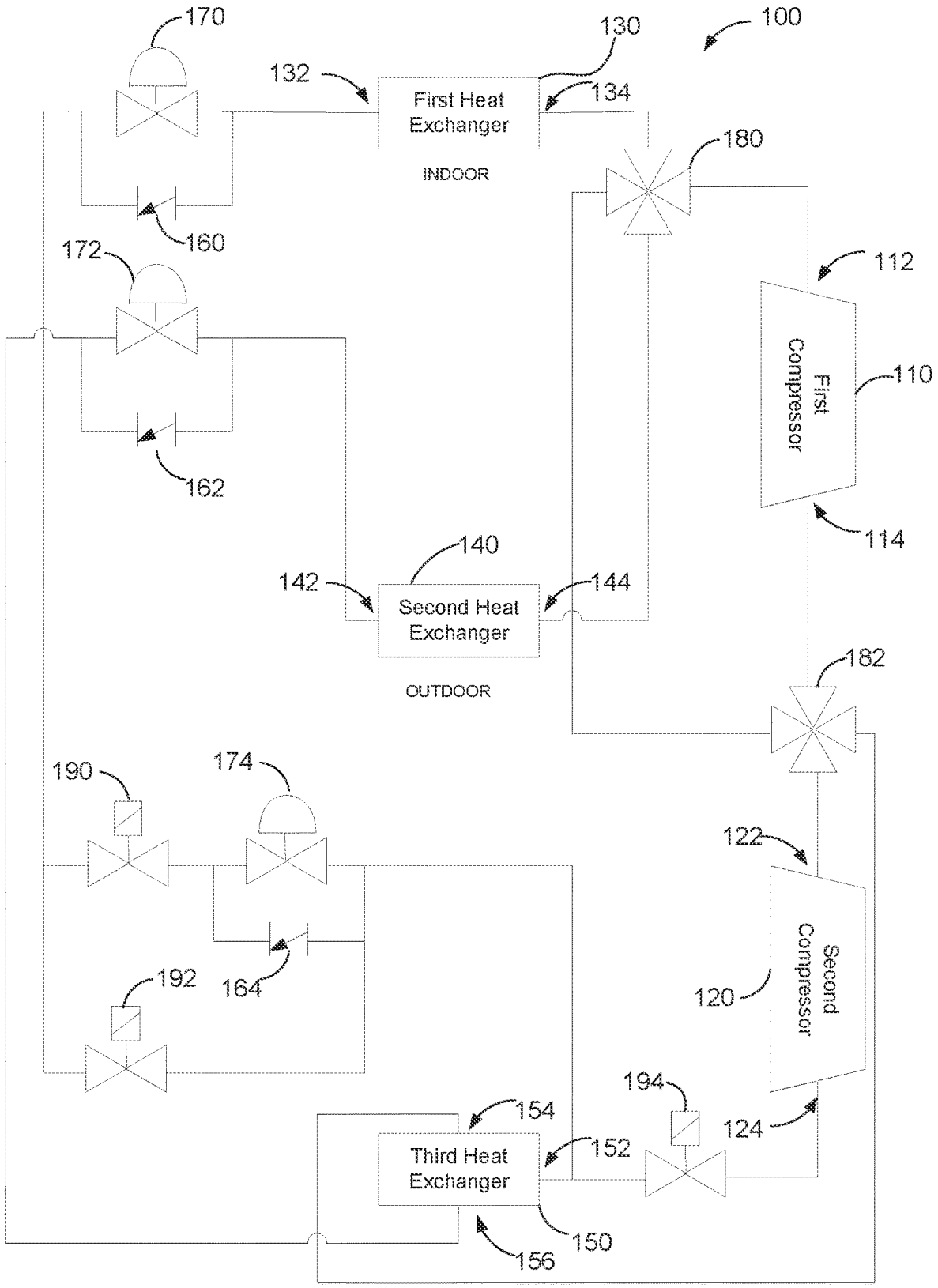
FIG. 1 is a schematic diagram of a heat pump system configured to operate in various operation modes, according to certain embodiments of the current invention.

Referring to FIG. 1, in some implementations, an example system 100 includes a plurality of compressors (e.g., first compressor 110 and second compressor 120) that are configured to work with a plurality of heat exchangers (e.g., first heat exchanger 130, second heat exchanger 140, and third heat exchanger 150) and a plurality of expansion devices (e.g., first expansion device 170, second expansion device 172, and third expansion device 174).

In some implementations, the first compressor 110 is a high-pressure compressor which generates high-pressure refrigerant, and the second compressor 120 is a low-pressure compressor which generates medium-pressure refrigerant. As used herein a high-pressure refrigerant means a pressure between 300-500 psi, a medium-pressure refrigerant means a pressure between 200-300 psi, and a low-pressure refrigerant means a pressure less than 200 psi. It is contemplated herein that multiple refrigerants may be utilized within the same system.

As the compressor 110, 120 compresses the one refrigerant or respective refrigerants, the temperature of the compressed refrigerant (i.e., high-pressure refrigerant) increases. As the refrigerant decompresses or expands at the expansion device 170, 172, 174 (e.g., expansion valves), the refrigerant becomes cooler. Expansion devices 170, 172, 174 for heat pumps are known, and any expansion device currently known or used may be adapted for use herein, illustratively including an expansion valve commonly referred to as a thermal expansion valve.

As shown, various components are implemented to direct the circulation of the refrigerant in the system 100 based on the operation mode. For example, a first check valve 160, a second check valve 162, and a third check valve 164 are to allow the refrigerant to bypass the first expansion device 170, the second expansion device 172, and the third expansion device 174, respectively. In some implementations, as shown, the system 100 includes a first reversing valve 180 and a second reversing valve 182 that are configured to direct the circulation of the refrigerant based on the operation mode. As shown, in some implementations, the system 100 utilizes a plurality of solenoid valves (e.g., first solenoid valve 190, second solenoid valve 192, and third solenoid valve 194) to direct the circulation of the refrigerant based on the operation mode. In some implementations, the plurality of solenoid valves are bi-directional solenoid valves.

As discussed, the system 100 is configured to operate in various modes: cooling mode; heating mode for normal climate conditions; and cascaded heating mode for cold climate conditions.

Cascaded Heating Mode

Referring to FIG. 1, when the system 100 operates in the cascaded heating mode for cold climate conditions (e.g., −30° C. outdoor ambient air), the first compressor 110 (e.g., high-pressure compressor) and the second compressor 120 (e.g., low-pressure compressor) are energized (i.e., in operation). As will be described later in the present disclosure, a first stream of the refrigerant from the first compressor 110 and a second stream of the refrigerant from the second compressor 120 cycle within the system 100 separately until the two streams are intersected (i.e., mixed) at the third heat exchanger 150. The first stream of the refrigerant provides medium-pressure cold liquid/gas refrigerant and the second stream of the refrigerant provides medium-pressure hot gas refrigerant. The third heat exchanger 150 is configured to output the mixture of the first stream of the refrigerant and the second stream of the refrigerant into medium-pressure saturated vapor and medium-pressure liquid refrigerant.

The medium-pressure saturated vapor (e.g., hot gas refrigerant) from the mixture (located at the third heat exchanger 150) is separately output from the third heat exchanger 150 and flows to the first compressor 110, and the medium-pressure saturated vapor supplied to the first compressor 110 will become high-pressure hot gas refrigerant (hotter than the saturated vapor from the third heat exchanger 150) at the first compressor 110. Then, the high-pressure hot gas refrigerant flows to the first heat exchanger 130 located indoors and releases its thermal energy to the ambient indoor air—heating the indoor air. The medium-pressure liquid refrigerant from the mixture (located at the third heat exchanger 150) is separately output from the third heat exchanger 150 and flows to the second expansion device 172. At the second expansion device 172, the refrigerant becomes colder (or significantly colder) than the temperature of the outdoor ambient air and flows to the second heat exchanger 140 where the cold refrigerant absorbs the thermal energy from the outdoor ambient air. As shown in FIG. 1, the refrigerant which captured the outdoor thermal energy flows to the second compressor 120 where the medium-pressure hot gas refrigerant is generated using the refrigerant.

As described above, the system 100 is configured to utilize the medium-pressure saturated vapor and the medium medium-pressure liquid refrigerant from the third heat exchanger 150 to capture more thermal energy from outdoor ambient air in cold climate and to provide more thermal energy to heat the indoor air. In some implementations, the same type of the refrigerant is used for the first compressor 110 and the second compressor 120 to reduce the overall cost of ownership (including costs related to manufacturing, operating, maintaining, and installing the system).

As stated above, the first compressor 110 (e.g., high-pressure compressor) and the second compressor 120 (e.g., low-pressure compressor) are energized (i.e., in operation) when the system 100 is in the cascaded heating mode.

In the cascaded heating mode, the third solenoid valve 194, in fluid communication with the second compressor 120, is energized (i.e., open) to utilize the second compressor 120. In the cascaded heating mode, the first reversing valve 180 is also energized to provide a conduit (i.e., fluid communication channel) between a first port 112 of the first compressor 110 and a second port 134 of the first heat exchanger 130. By the conduit formed between the first port 112 of the first compressor 110 and the second port 134 of the first heat exchanger 130, high-pressure high temperature gas refrigerant flows from the first compressor 110 to the first heat exchanger 130 located indoors. As the indoor air, which is relatively colder than the refrigerant from the first compressor 110, passes over the first heat exchanger 130, the energy (e.g., thermal energy) from the refrigerant is transferred to the indoor air. Thus, the indoor air is warmed. As a result, after passing the first heat exchanger 130, the refrigerant cools down into liquid state (i.e., high-pressure "slightly cooler" liquid refrigerant).

As shown, the first expansion device 170 is in parallel with the first check valve 160, and the first expansion device 170 and the first check valve 160 are in fluid communication with a first port 132 of the first heat exchanger 130. When the system 100 operates in the cascaded heating mode, the first check valve 160 is energized (i.e. open or in bypass mode) so that the high-pressure "slightly cooler" liquid refrigerant from the first heat exchanger 130 bypasses the first expansion device 170. As a result, the pressure of the high-pressure "slightly cooler" liquid refrigerant from the first heat exchanger 130 is maintained.

As shown, the first expansion device 170 is fluidly coupled with the first check valve 160. The first solenoid valve 190 and the second solenoid valve 192 control the flow of refrigerant to and from the first expansion device 170 and the first check valve 160. When the system 100 operates in the cascaded heating mode, the first solenoid valve 190 is energized (i.e., open) and the second solenoid valve 192 is not energized (i.e., closed). The high-pressure "slightly cooler" liquid refrigerant from the first heat exchanger 130 flows to the first solenoid valve 190.

As shown, the first solenoid valve 190 is also in fluid communication with the third expansion device 174 and the third check valve 164. When the system 100 operates in the cascaded heating mode, the third check valve 164 is not energized (i.e., closed or non-bypass mode). Since the third check valve 164 is not energized, the high-pressure "slightly cooler" liquid refrigerant from the first heat exchanger 130 flows into the third expansion device 174 and expands and the pressure of the refrigerant drops. As a result, the high-pressure "slightly cooler" liquid refrigerant from the first heat exchanger 130 expands at the third expansion device 174 and becomes medium-pressure cold liquid/gas refrigerant.

As shown, the third expansion device 174 is in fluid communication with a first port 152 of the third heat exchanger 150. As a result, the medium-pressure cold liquid/gas refrigerant from the third expansion device 174 (i.e., the first stream of the refrigerant from the first compressor 110) flows to the third heat exchanger 150.

When the system 100 operates in the cascaded heating mode, the third solenoid valve 194 is energized (i.e., open) so that the first port 124 of the second compressor 120 and the first port 152 of the third heat exchanger 150 are in fluid communication. As a result, medium-pressure hot gas refrigerant from the second compressor 120 (i.e., the second stream of the refrigerant from the second compressor 120) flows to the third heat exchanger 150 and is mixed with the medium-pressure cold liquid/gas refrigerant from the third expansion device 174 at the third heat exchanger 150.

In some implementations, the third heat exchanger 150 includes a flash-tank-heat-exchanger. As shown, a second port 154 of the third heat exchanger 150 is in fluid communication with the second reversing valve 182. When the system 100 operates in the cascaded heating mode, the second reversing valve 182 is energized to provide a conduit (i.e., fluid communication channel) between the second port 154 of the third heat exchanger 150 and a second port 114 of the first compressor 110. As a result, medium-pressure saturated gas refrigerant of the mixture in the third heat exchanger 150 flows to the first compressor 110.

As shown, a third port 156 of the third heat exchanger 150 is in fluid communication with the second expansion device 172. The second expansion device 172 is in parallel with the second check valve 162. When the system 100 operates in the cascaded heating mode, the second check valve 162 is not energized (i.e., closed or non-bypass mode). As a result, medium-pressure liquid refrigerant flows from the third port 156 of the third heat exchanger 150 to the second expansion device 172 and expands at the second expansion device 172. As a result, the temperature of the medium-pressure liquid refrigerant and the pressure of the medium-pressure liquid refrigerant drop.

As shown, the second expansion device 172 is in fluid communication with a first port 142 of the second heat exchanger 140. As a result, the low-pressure cooler liquid refrigerant output from the second expansion device 172 flows to a first port 142 of the second heat exchanger 140 located outdoors. Since the low-pressure cooler liquid refrigerant from the second expansion device 172 is colder (or significant colder) than outdoor ambient air temperature, the low-pressure cooler liquid refrigerant absorbs the thermal energy from the outdoor ambient air and becomes low-pressure hot gas refrigerant at the second heat exchanger 140. The low-pressure hot gas refrigerant flows through a second port 144 to the first reversing valve 180 and is directed by the first reversing valve 180 (in an energized state) and the second reversing valve 182 (in an energized state) to a second port 122 of the second compressor 120. The refrigerant circulates in accordance with the loops described above when the system 100 is in the cascade heating mode.

As discussed, the system 100 is includes a liquid receiver (e.g., the third heat exchanger 150). The third heat exchanger 150 includes one input port (first port 152) and two output ports (second port 154 and third port 156 as shown) in the cascade heating mode for the cold climate applications. As discussed above, both the medium-pressure hot refrigerant from the second compressor 120 and the medium-pressure cold liquid/gas refrigerant from the third expansion device 174 flow into the third heat exchanger 150 via the first port 152 of the third heat exchanger 150. As discussed above, at the third heat exchanger 150, both of the refrigerants are mixed. After mixing, a first portion of the mixture (i.e., medium-pressure saturated gas refrigerant) is cycled back to the first compressor 110 and a second portion of the mixture (i.e., medium-pressure liquid refrigerant) is cycled back to the second compressor 120 as the low-pressure hot gas refrigerant.

In the present disclosure, with the third heat exchanger 150 which is capable of supporting two different refrigerant cycles (i.e., liquid refrigerant cycle and gas refrigerant cycle) using the one input port (i.e., first port 152) and two output ports (i.e., second port 154 and third port 156), a consistent rate of refrigerant is provided to the first compressor 110 and the second compressor 120—resulting an efficient cascade heat pump system for cold climate applications.

Heating Mode

Referring to FIG. 1, when the system 100 operates in the heating mode for normal climate conditions (e.g., temperatures at or above 8° C.), the first compressor 110 is energized (in operation) and the second compressor 120 is not energized (not in operation). In the heating mode, the third solenoid valve 194 is not energized (i.e., closed) as well. In the heating mode, the first reversing valve 180 is energized to provide a conduit (i.e., fluid communication channel) between the first port 112 of the first compressor 110 and the second port 134 of the first heat exchanger 130. By the conduit formed between the first port 112 of the first compressor 110 and the second port 134 of the first heat exchanger 130, high-pressure hot gas refrigerant flows from the first compressor 110 to the first heat exchanger 130 located indoors. As the indoor air, which is relatively colder than the refrigerant from the first compressor 110, passes over the first heat exchanger 130, the energy (e.g., thermal energy) from the refrigerant is transferred to the indoor air. Thus, the indoor air becomes warm. As a result, after passing the first heat exchanger 130, the refrigerant cools down into liquid state (i.e., high-pressure "slightly cooler" liquid refrigerant).

As shown, the first expansion device 170 is in parallel with the first check valve 160. The first expansion device 170 and the first check valve 160 are in fluid communication with a first port 132 of the first heat exchanger 130. When the system 100 operates in the heating mode, the first check valve 160 is energized (i.e., open or bypass mode) so that the high-pressure "slightly cooler" liquid refrigerant from the first heat exchanger 130 bypasses the first expansion device 170. As a result, the pressure of the high-pressure slightly cooler liquid refrigerant from the first heat exchanger 130 is maintained.

As shown, the first expansion device 170 and the first check valve 160 is in fluid communication with the first solenoid valve 190 and the second solenoid valve 192. When the system 100 operates in the heating mode, the first solenoid valve 190 is not energized (i.e., closed) and the second solenoid valve 192 is energized (i.e., open). The high-pressure "slightly cooler" liquid refrigerant from the first heat exchanger 130 flows to the first solenoid valve 190 and the second solenoid valve 192.

As shown, the first solenoid valve 190 is in fluid communication with the third expansion device 174 that is connected in parallel with the third check valve 164. When the system 100 operates in the heating mode, the third check valve 164 is energized (i.e., open or bypass mode). Since the third check valve 164 is energized, the high-pressure "slightly cooler" liquid refrigerant bypasses the third expansion device 174. As a result, the pressure of the high-pressure "slightly cooler" liquid refrigerant from the first heat exchanger 130 is maintained.

As shown, the third expansion device 174 is in fluid communication with the first port 152 of the third heat exchanger 150. As a result, the high-pressure "slightly cooler" liquid refrigerant from the first heat exchanger 130 flows to the third heat exchanger 150 via the first solenoid valve 190.

As shown, the second solenoid valve 192 in fluid communication with the first port 152 of the third heat exchanger 150. As a result, the high-pressure "slightly cooler" liquid refrigerant from the first heat exchanger 130 also flows to the third heat exchanger 150 via the second solenoid valve 192.

As shown, the third port 156 of the third heat exchanger 150 is in fluid communication with the second expansion device 172 and the second check valve 162. When the system 100 operates in the heating mode, the second check valve 162 is not energized (i.e., closed or non-bypass mode). As a result, high-pressure liquid refrigerant flows from the third port 156 of the third heat exchanger 150 to the second expansion device 172 and expands at the second expansion device 172. Accordingly, the pressure of the refrigerant drops.

As shown, the second expansion device 172 is in fluid communication with the first port 142 of the second heat exchanger 140 located outdoors. As a result, the low-pressure cooler liquid refrigerant output from the second expansion device 172 flows to a first port 142 of the second heat exchanger 140 located outdoors. Since the low-pressure cooler liquid refrigerant from the second expansion device 172 is colder than outdoor ambient air temperature, the low-pressure cooler liquid refrigerant absorbs the thermal energy from the outdoor ambient air and becomes low-pressure hot gas refrigerant at the second heat exchanger 140. When the system 100 operates in the heating mode, the first reversing valve 180 is energized, and the second reversing valve 182 is not energized. Accordingly, the low-pressure hot gas refrigerant from the second heat exchanger 140 is directed by the first reversing valve 180 and the second reversing valve 182 to a second port 122 of the first compressor 110. The refrigerant circulates in accordance with the loop described above when the system 100 is in the heating mode.

Cooling Mode

Referring to FIG. 1, when the system 100 operates in the cooling mode for normal climate conditions, the first compressor is energized (i.e. in operation), but the second compressor is not energized (i.e., not in operation). In the cooling mode, the third solenoid valve 194 is not energized (i.e., closed) as well. In the cooling mode, the first reversing valve 180 is not energized to provide a conduit (i.e., fluid communication channel) between the first port 112 of the first compressor 110 and the second port 143 of the second heat exchanger 140 located outdoors. By the conduit formed between the first port 112 of the first compressor 110 and the second port 143 of the second heat exchanger 140, high-pressure hot gas refrigerant flows from the first compressor 110 to the second heat exchanger 140 located outdoors. As the outdoor air, which is relatively colder than the refrigerant from the first compressor 110, passes over the second heat exchanger 140, the energy (e.g., thermal energy) from the refrigerant is transferred to the outdoor air. As a result, after passing the second heat exchanger 140, the refrigerant cools down into liquid state (i.e., high-pressure "slightly cooler" liquid refrigerant).

As shown, the second expansion device 172 is in parallel with the second check valve 162. The second expansion device 172 and the second check valve 162 are in fluid communication with a first port 142 of the second heat exchanger 140. When the system 100 operates in the cooling mode, the second check valve 162 is energized (i.e., open or in bypass mode) so that the high-pressure slightly cooler liquid refrigerant from the second heat exchanger 140 bypasses the second expansion device 172. As a result, the pressure of the high-pressure "slightly cooler" liquid refrigerant from the second heat exchanger 140 is maintained.

As shown, the second expansion device 172 is in parallel with the second check valve 162 and is in fluid communication with the third port 156 of the third heat exchanger 150. When the system 100 operates in the cooling mode, the first solenoid valve 190 and the third solenoid valve 194 are not energized (i.e., close) and the second solenoid valve 192 is energized (i.e., open).

As shown, the first port 152 of the third heat exchanger 150 is in fluid communication with the second solenoid valve 192 and the second solenoid valve 192 is in fluid communication with the first expansion device 170 and the first check valve 160. As a result, the high-pressure "slightly cooler" liquid refrigerant from the second heat exchanger 140 flows to the first expansion device 170 and the first check valve 160. When the system 100 operates in the cooling mode, the first check valve 160 is not energized (i.e., closed or non-bypass mode). The high-pressure "slightly cooler" liquid refrigerant from the second heat exchanger 140 flows to the first expansion device 170 and expands at the first expansion device 170. The expanded refrigerant becomes low-pressure cold liquid refrigerant.

As shown, the first expansion device 170 is in fluid communication with the first port 132 of the first heat exchanger 130 located indoor. The low-pressure cold liquid refrigerant will absorb heat from indoor air and become low-pressure hot gas refrigerant. When the system 100 operates in the cooling mode, the first reversing valve 180 and the second reversing valve 182 are not energized to provide a conduit between the second port 134 of the first heat exchanger 130 and the second port 114 of the first compressor 110. The low-pressure hot gas refrigerant flows back to the first compressor 110 by the conduit. The refrigerant circulates in accordance with the loop described above when the system 100 is in the cooling mode.

Switching Between Modes

As discussed, the system 100 is configured to operate in various modes: cooling mode; heating mode for normal climate conditions; and cascaded heating mode for cold climate conditions. As shown above, the operation mode of the system 100 is capable of seamlessly switching from one of the three modes to another by simply applying corresponding settings for respective components. Table 1 below shows combinations of component settings based on the operation mode.

As shown, the first compressor 110 (Comp1), the second compressor 120 (Comp2), the first reversing valve 180 (RV1), the second reversing valve 182 (RV2), the first solenoid valve 190 (SV1), and the third solenoid valve 194 (SV3) are energized when the system 100 is in the cascade heating mode (Cascade HP). While other components are energized, the second solenoid valve 192 (SV2) is not energized when the system 100 is in the cascade heating mode (Cascade HP).

As shown, the first compressor 110 (Comp1), the first reversing valve 180 (RV1), the first solenoid valve 190 (SV1), and the second solenoid valve 192 (SV2) are energized when the system 100 is in the heating mode for normal climate conditions (Single Stage HP). While other components are energized, the second compressor 120 (Comp2), the second reversing valve 182 (RV2), and the third solenoid valve 194 (SV3) are not energized when the system 100 is in the heating mode for normal climate conditions.

As shown, the first compressor 110 (Comp1), the first reversing valve 180 (RV1), and the second solenoid valve 192 (SV2) are energized when the system 100 is in the cooling mode (Single Stage AC). While other components are energized, the second compressor 120 (Comp2), the second reversing valve 182 (RV2), and the first solenoid valve 190 (SV1), and the third solenoid valve 194 (SV3) are not energized when the system 100 is in the cooling mode.

TABLE 1

Component settings based on the operation mode.

| | Component | | | | | | |
|---|---|---|---|---|---|---|---|
| Mode | Comp1 | Comp2 | RV1 | RV2 | SV1 | SV2 | SV3 |
| Cascade HP | ON | ON | ON | ON | ON | OFF | ON |
| Single Stage HP | ON | OFF | ON | OFF | OFF | ON | OFF |
| Single Stage AC | ON | OFF | ON | OFF | OFF | ON | OFF |

Exemplary Implementation with Multi-Level Converter

Figure 2:
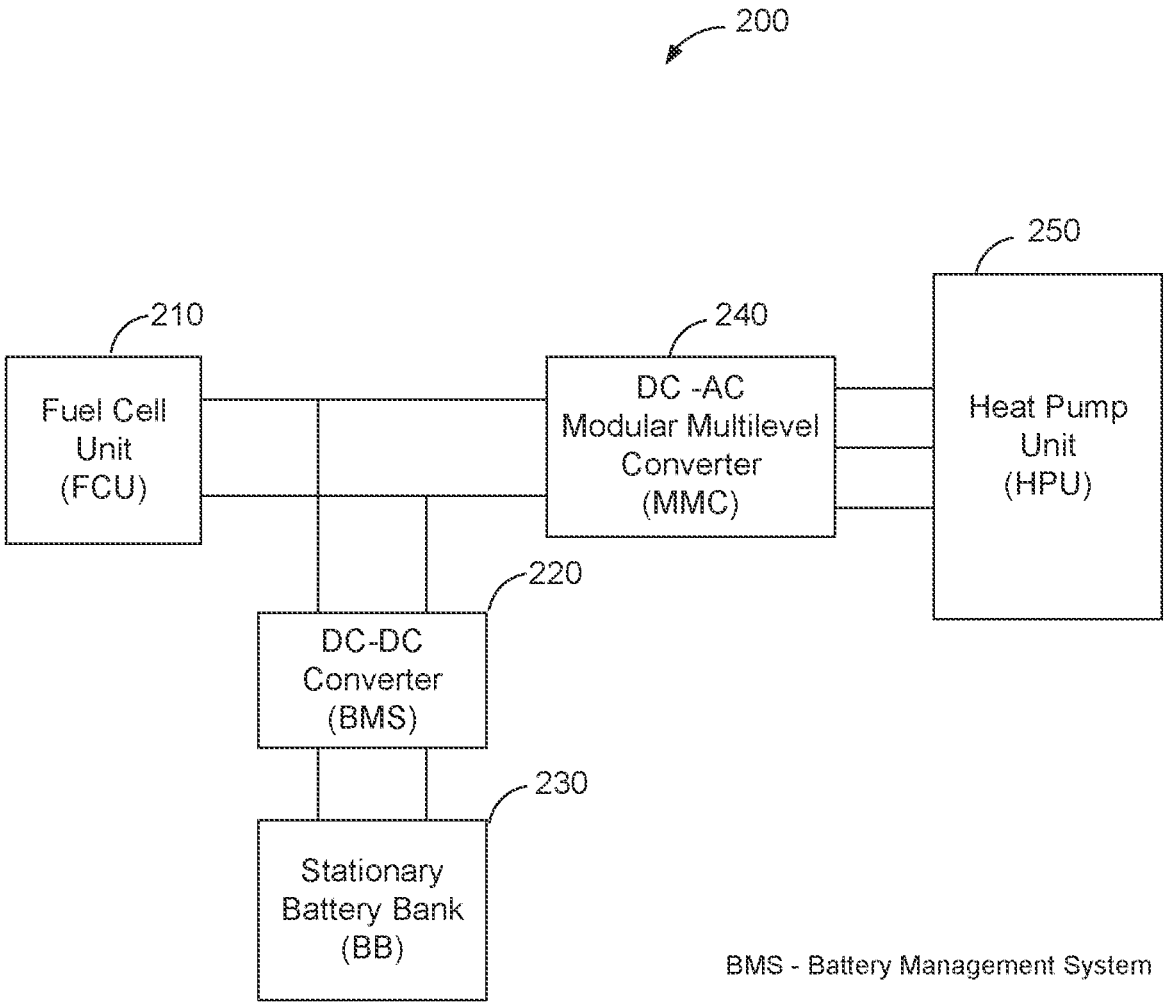
FIG. 2 is a schematic diagram of a heat pump system integrated with a modular multi-level converter.

FIG. 2 is a schematic diagram of a heat pump system integrated with a modular multi-level converter.

Referring to FIG. 2, in some implementations, an example system 200, for off-grid applications, includes a fuel cell unit 210, a battery management system 220, a stationary battery bank 230, a DC-AC modular multi-level converter 240, and a heat pump unit 250. The fuel cell unit 210 includes various components (including a hydrogen storage tank, a fuel cell, and condenser) to provide electrical power (e.g., direct current) derived from the fuel cell via its output. The battery management system 220 coupled to the output is configured to control the charging and discharging of the stationary battery bank 230, so the stationary battery bank 230 (e.g., backup battery) is in the optimal condition.

As shown, the modular multi-level converter 240 is coupled to the fuel cell unit 210 and the stationary battery bank 230 (via the battery management system 220). The modular multi-level converter 240 (e.g., nine-level modular multi-level converter) is configured to regulate power from the fuel cell unit 210 to power the heat pump unit 250, such as stepping up power, preventing power peaks, or stepping down power. In one aspect, where the heat pump unit 250 operates off of AC electrical power, the modular multi-level converter 240 is configured to generate AC electrical power (e.g., three-phase AC electrical power) by converting DC electrical power from the fuel cell unit 210 and/or the stationary battery bank 230. In some implementations, the modular multi-level converter 240 includes Gallium Nitride (GaN) controlling components that increases efficiency of the DC-AC conversion. The AC electrical power generated by the modular multi-level converter 240 is provided for operating the heat pump unit 250. In some implementations, the heat pump unit 250 includes the system 100.

Testing and Evaluation

Figure 3:
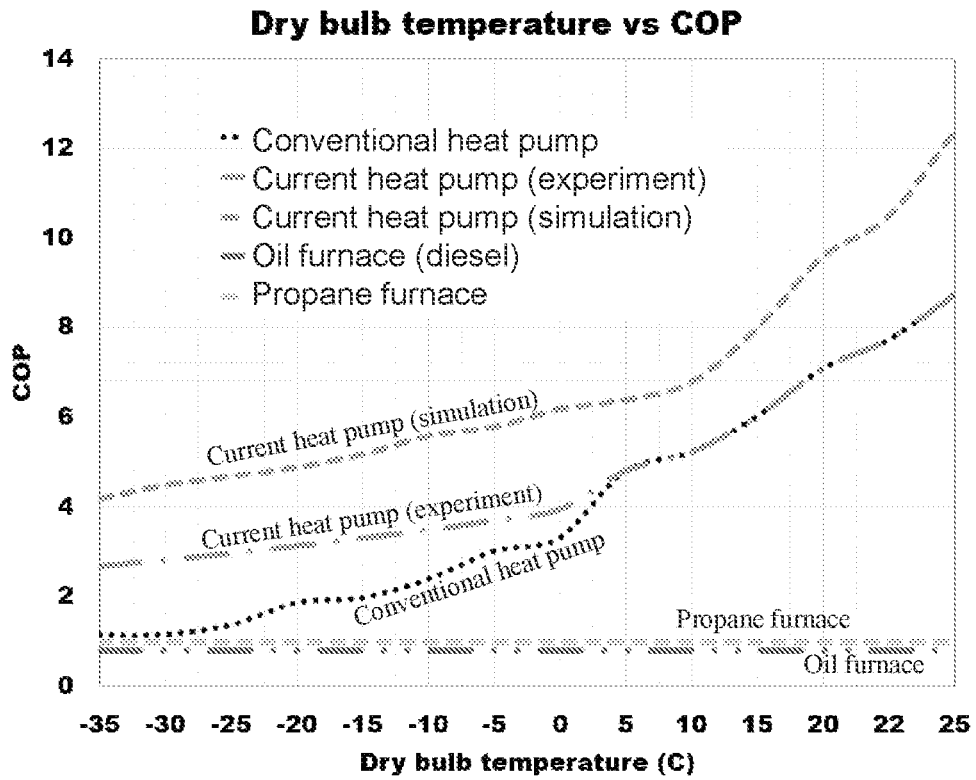
FIG. 3 is a comparison graph that shows the efficiency of a heat pump system in terms of the Coefficient of Performance at various temperatures.

FIG. 3 is a comparison graph 300 that shows the results obtained from a prototype of the heat pump system 100 under different conditions (e.g., at various ambient air temperatures). The graph 300 also compares the efficiency of the heat pump system 100 with an existing heat pump system and other various traditional space heating systems, such as oil furnace (diesel) and propane furnace in terms of the coefficient of performance.

As discussed, the heat pump system 100 includes the liquid receiver (e.g., third heat exchanger 150 in FIG. 1) to overcome the inefficiency associated with the existing heat pump systems. In particular, the liquid receiver is configured to provide a consistent flow of refrigerant to one or more compressors (e.g., the first compressor 110 and the second compressor 120 in FIG. 1) in the heat pump system 100. The consistent flow also supplies an outdoor heat exchanger (e.g., second heat exchanger 140 in FIG. 1) consistent flow of the refrigerant which is colder than ambient air temperature. Thus, the heating capability and the COP of the heat pump system 100 are maintained under cold climate conditions.

The COP is calculated using Equations (1) and (2).

$$COP = \frac{Q_H}{W_c} \tag{1}$$

where $Q_H$ is the heat leaving a condenser (into the house) and $W_c$ is the total energy required to power the system (e.g., for the compressors and sensors). The COP is a measure of how much heat will be generated out of the pump for every unit of electrical energy needed to power the compressors (and other equipment). The higher the COP, the more heat is generated in the system for every unit of electricity put into the system.

$$m = \rho Q \tag{2}$$

where m is the mass flow, ρ is the density at the given measured temperature and pressure, and Q is the measured volumetric flow rate. The volumetric flow rate of refrigerant is likely the easiest to measure (using a flow meter), and can be converted to a mass flow rate using Equation 1. The mass flow rate throughout the system is constant, as no mass should be created or destroyed anywhere as the system is closed.

As shown in FIG. 3, it is clear from the results that the prototype based on the heat pump system 100 has a COP of 3.0 at −25° C. which is significantly higher than COPs of other heating systems including existing heat pump systems at −25° C. This indicates that the heat pump system 100 including the liquid receiver actually works under cold climate conditions and is capable of providing cost efficient heating for cold climate conditions. Also, as shown, with further optimization of the prototype, the COP of the heat pump system 100 can be improved to the point where the actual results from the heat pump system 100 are close to simulation results of the heat pump system 100 shown in FIG. 3 (e.g., a COP of 4.7 at −25° C.).

A number of implementations have been described. Nevertheless, it will be understood that various modifications may be made without departing from the spirit and scope of the disclosure. Accordingly, other implementations are within the scope of the following claims.

What is claimed is:

1. A heat pump system comprising:

a plurality of compressors including a first compressor and a second compressor, each compressor having a first port and a second port;

a plurality of heat exchangers including a first heat exchanger in communication with the first port of the first compressor, a second heat exchanger, and a third heat exchanger, wherein the third heat exchanger comprises an input port and a plurality of output ports, such that:

the first port of the second compressor is in fluid communication with the input port of the third heat exchanger, the second port of the first compressor is in fluid communication with a first of the plurality of output ports of the third heat exchanger;

a plurality of expansion devices including a first expansion device in communication with the first heat exchanger, a second expansion device in communication with the second heat exchanger and with a second of the plurality of output ports of the third heat exchanger, and a third expansion device in communication with the input port of the third heat exchanger, wherein, when the system operates in a cascade heating mode, the third heat exchanger is configured to:

receive a first portion of refrigerant from the first compressor and a second portion of refrigerant from the second compressor via the input port of the third heat exchanger, provide a first consistent flow of refrigerant from the second of the plurality of output ports to the first compressor, and provide a second consistent flow of refrigerant from the first of the plurality of output ports to the second compressor.

2. The heat pump system of claim 1, wherein the third heat exchanger includes a flash-tank-heat-exchanger.

3. The heat pump system of claim 1, wherein the third heat exchanger is configured to contain a mixture of liquid refrigerant and vapor refrigerant.

4. The heat pump system of claim 1, wherein the third heat exchanger is configured to output a vapor portion of mixture of the first portion and second portion of the refrigerant via the first of the plurality of outputs and a liquid portion of mixture of the first portion and second portion of the refrigerant via the second of the plurality of outputs.

5. The heat pump system of claim 1, wherein the second heat exchanger is in fluid communication with an input port of the second compressor when the system operates in the cascade heating mode.

6. The heat pump system of claim 1, wherein the second heat exchanger is located outdoors.

7. The heat pump system of claim 1, wherein the first compressor includes a high-pressure compressor.

8. The heat pump system of claim 1, wherein the second compressor includes a low-pressure compressor.

9. The heat pump system of claim 1, wherein the first compressor and the second compressor are in operation when the system operates in the cascade heating mode.

10. The heat pump system of claim 1, wherein when system operates in a heating or a cooling mode, the first compressor is in operation and the second compressor is not in operation.

11. The heat pump system of claim 1, wherein before received by the third exchanger, the first portion of refrigerant passes through the first heat exchanger and the third expansion device.

12. The heat pump system of claim 11, wherein the first heat exchanger is located indoors.

13. A heating and cooling system comprising:

a fuel cell unit;

a backup battery unit including a battery management circuitry;

a direct current (DC) to alternate current (AC) converter; and the heat pump system of claim 1, wherein the direct current (DC) to alternate current (AC) converter is configured to:

receive direct current from the fuel cell or the backup battery unit;

convert the direct current to alternate current; and supply the alternate current to the heat pump system of claim 1.

14. The system of claim 13, wherein the DC to AC converter includes a nine-level modular multi-level converter.

15. The system of claim 13, wherein fuel cell unit includes a hydrogen storage tank, a fuel cell, and a condenser.

16. The system of claim 13, wherein the battery management circuitry is configured to maintain the backup battery.

* * * * *